US009837753B1

(12) United States Patent
Chen

(10) Patent No.: US 9,837,753 B1
(45) Date of Patent: Dec. 5, 2017

(54) MODULE OUTLET

(71) Applicant: Liang Light Chen, Los Gatos, CA (US)

(72) Inventor: Liang Light Chen, Los Gatos, CA (US)

(73) Assignee: Six Sights Corporation, Campbell, CA (US)

( * ) Notice: Subject to any disclaimer, the term of this patent is extended or adjusted under 35 U.S.C. 154(b) by 0 days.

(21) Appl. No.: 15/387,129

(22) Filed: Dec. 21, 2016

(51) Int. Cl.

| | |
|---|---|
| ***H01R 13/514*** | (2006.01) |
| ***H01R 24/78*** | (2011.01) |
| ***H01R 25/00*** | (2006.01) |
| ***H01R 27/02*** | (2006.01) |
| *H01R 103/00* | (2006.01) |

(52) U.S. Cl.
CPC ..... *H01R 13/514* (2013.01); *H01R 24/78* (2013.01); *H01R 25/006* (2013.01); *H01R 27/02* (2013.01); *H01R 2103/00* (2013.01)

(58) Field of Classification Search
CPC .. H01R 13/506; H01R 13/514; H01R 13/518; H01R 13/51; H01R 25/006; H01R 2103/00
USPC ..... 439/701, 717
See application file for complete search history.

(56) References Cited

U.S. PATENT DOCUMENTS

| | | | | |
|---|---|---|---|---|
| 5,201,674 | A * | 4/1993 | Okura | H01R 13/4361 439/594 |
| 5,295,870 | A * | 3/1994 | Rei | H01R 13/514 439/715 |
| 6,123,554 | A * | 9/2000 | Ortega | H01R 13/514 439/701 |
| 6,179,653 | B1 * | 1/2001 | Cheng | H01R 12/716 439/541.5 |
| 6,193,550 | B1 * | 2/2001 | Yamashita | H01R 13/514 439/594 |
| 7,316,591 | B2 * | 1/2008 | Ferderer | H01R 13/518 439/532 |
| 8,206,185 | B2 * | 6/2012 | Jehmlich | H01R 13/42 439/701 |
| 9,444,175 | B2 | 9/2016 | Chen | |
| 2002/0146941 | A1 * | 10/2002 | Bradley | H01R 13/114 439/701 |
| 2004/0171312 | A1 * | 9/2004 | Sichner | H01R 13/514 439/701 |
| 2007/0128951 | A1 * | 6/2007 | Leddy | H01R 13/514 439/701 |
| 2008/0003889 | A1 * | 1/2008 | Link | H01R 13/514 439/701 |

* cited by examiner

*Primary Examiner* — Gary Paumen
(74) *Attorney, Agent, or Firm* — Douglas L. Weller

(57) ABSTRACT

Housing for a module outlet includes first housing with a first opening configured to receive a body of a first outlet core so that a lip area of the first outlet core prevents the first outlet core from travelling through the first opening. A tab is configured to hold the body of the first outlet core secure within the first opening. A dovetail tongue is configured for sliding into a dovetail groove of a second module housing so as to secure the first module housing to the second module housing.

20 Claims, 8 Drawing Sheets

MODULE OUTLET

BACKGROUND

Outlets, also referred to as electrical outlets, power outlets or socket connectors, when connected to power serve as power conduits for appliances. Outlets can provide either Alternating Current (AC) or Direct Current (DC). For example, C13 outlets (female) and C14 appliance inlet (males) are frequently used with computer and computer related peripherals.

DESCRIPTION OF THE EMBODIMENT

Figure 1:
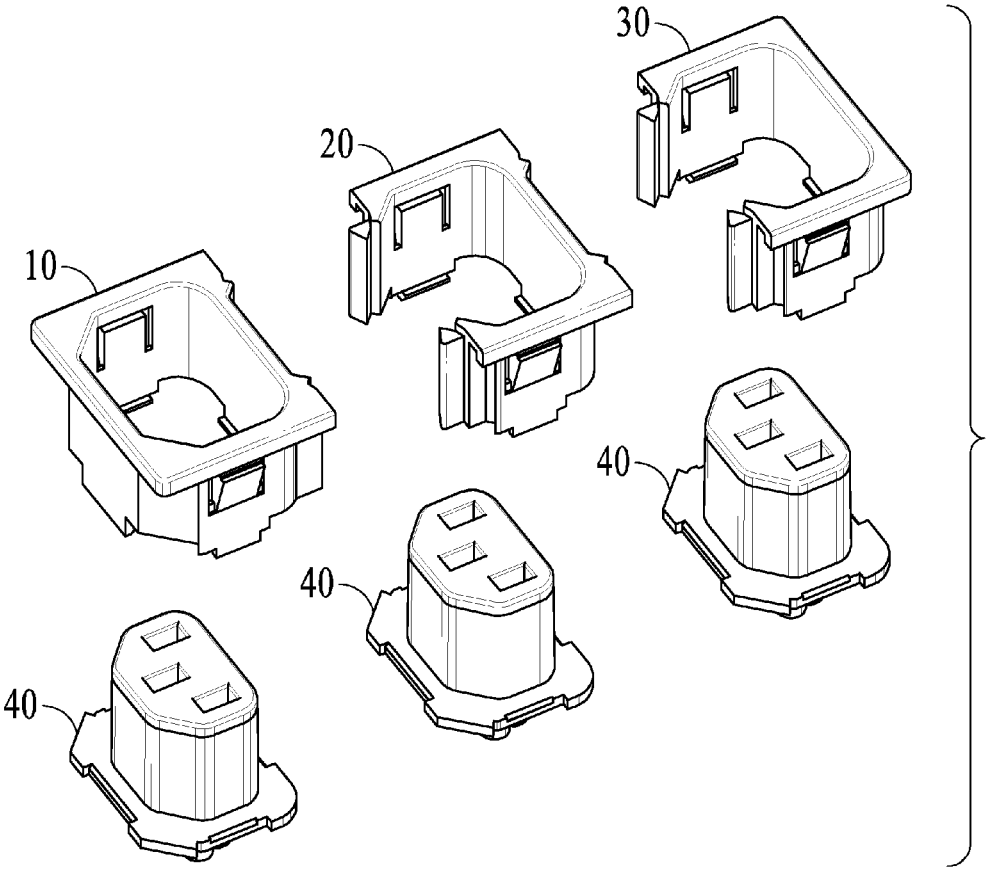
FIG. 1 shows a module outlet before assembly in accordance with an embodiment.

FIG. 1 shows base module housing 10, middle module housing 20, end module housing 30 and outlet cores 40 ready to be assembled into a module outlet. For example, each of outlet cores 40 is a C13 connector as specified by standards of International Electrotechnical Commission (IEC) 60320. Alternatively, each outlet core is another type of outlet compatible with another IEC standard or compatible with a standard from another standards organization or a special custom configuration. The outlets described herein are generally used as power outlets.

Figure 2:
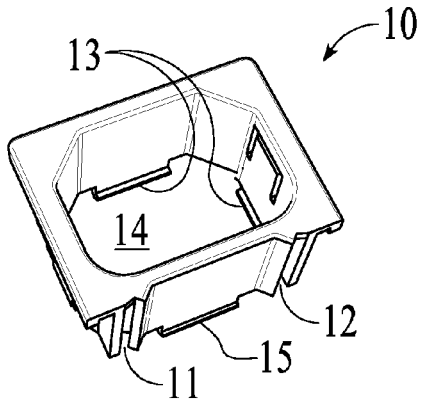
FIG. 2 and FIG. 3 show various views of base module housing for a single outlet core of a module outlet in accordance with an embodiment.
Figure 3:
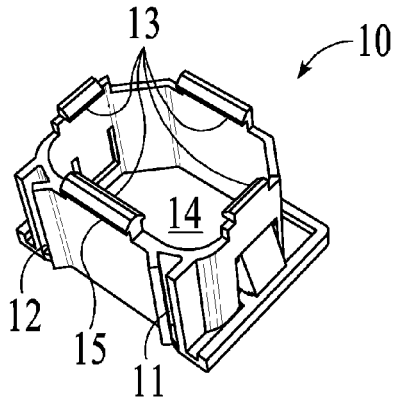

FIG. 2 and FIG. 3 show details of base module housing 10. An opening 14 is ready to receive an outlet core 40, which is placed in through a bottom of base module housing 10. Tabs 13 are used to lock outlet core 40 into place. A dovetail groove 11 and a dovetail groove 12 are configured to receive dovetail tongues from another module housing when building a module outlet. Base module housing 10 is configured so that it can be used in a stand-alone module outlet, or can be used as one end of a module outlet assembled with other module housing to form a module outlet with multiple outlets.

Figure 4:
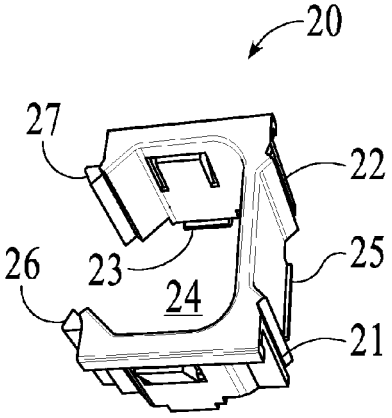
FIG. 4 shows middle module housing for a single outlet core of a module outlet in accordance with an embodiment.

FIG. 4 shows details of middle module housing 20. An opening 24 is ready to receive an outlet core 40, which is placed in through a bottom of middle module housing 20. Tabs 23 are used to lock outlet core 40 into place. A dovetail groove 21 and a dovetail groove 22 are configured to receive dovetail tongues from another module housing when building a module outlet. A dovetail tongue 26 and a dovetail tongue 27 are configured to be placed in dovetail grooves of from another module housing when building a module outlet.

Figure 5:
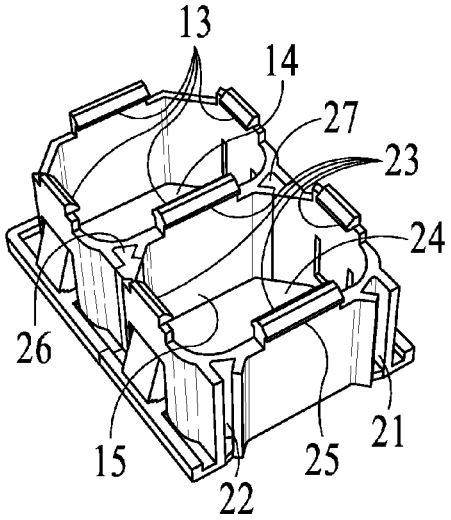
FIG. 5 shows the base module housing shown in FIGS. 2 and 3 joined with the middle module housing shown in FIG. 4 in accordance with an embodiment.

FIG. 5 shows base module housing 10 assembled with middle module housing 20. Dovetail tongue 26 of middle module housing 20 has been slid into dovetail groove 11 of base module housing 10. Dovetail tongue 27 of middle module housing 20 has been slid into dovetail groove 12 of base module housing 10. As shown in FIG. 5, a tab 15 of base module housing 10 is now configured so that when an outlet core 40 is placed within opening 24 of middle module housing 20, tab 15 of base module housing 10 is used with tabs 23 of middle module housing 20 to lock the outlet core 40 into place.

Figure 6:
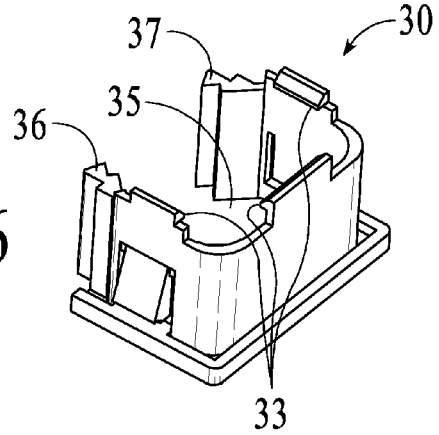
FIG. 6 shows end module housing for a single outlet core of a module outlet in accordance with an embodiment.

FIG. 6 shows details of end module housing 30. An opening 35 is ready to receive an outlet core 40, which is placed in through a bottom of end module housing 30. Tabs 33 are used to lock outlet core 40 into place. A dovetail tongue 36 and a dovetail tongue 37 are configured to be placed in dovetail grooves of from another module housing when building a module outlet.

Figure 7:
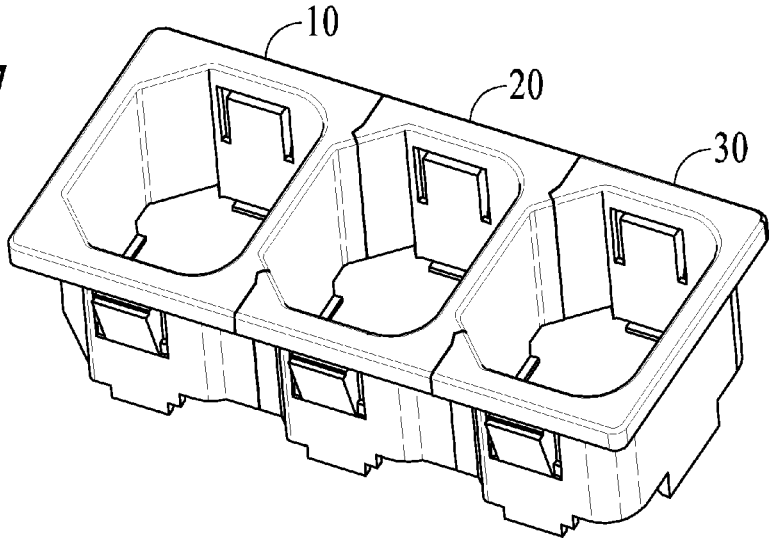
FIG. 7 shows the base module housing shown in FIGS. 2 and 3 joined with the middle module housing shown in FIG. 4 and the end module housing shown in FIG. 6 in accordance with an embodiment.

FIG. 7 shows end module housing 30 assembled with middle module housing 20 and base module housing 10 into housing for a module outlet. When assembled, dovetail tongue 36 of end module housing 30 is slid into dovetail groove 21 of middle module housing 20. Dovetail tongue 37 of end module housing 30 has been slid into dovetail groove 22 of middle module housing 20. A tab 25 of middle module housing 20 is configured so that when an outlet core 40 is placed within opening 35 of end module housing 30, tab 25 of middle module housing 20 is used with tabs 33 of end module housing 30 to lock the outlet core 40 into place.

While FIG. 7 shows three module housing parts assembled together, any number of module housing parts can be assembled together. For example, end module housing 30 can be joined directly to base module housing 10 to form a module outlet with two-outlets. For example, a module outlet with four-outlets can be formed by assembling two of middle module housing 20 between end module housing 30 and base module housing 10. For example, a module outlet with five-outlets can be formed by assembling three of middle module housing 20 between end module housing 30 and base module housing 10. And so on.

Figure 8:
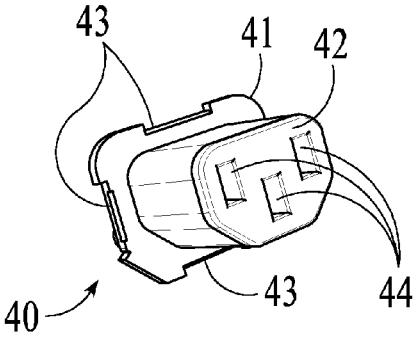
FIG. 8 and FIG. 9 show various views of a single outlet core of a module outlet in accordance with an embodiment.

FIG. 8 shows details of outlet core 40. Outlet core 40 includes plug receptors 44 in a body 42 of outlet core 40. When outlet core 40 is assembled into base module housing 10, body 42 of outlet core 40 is placed up through opening 14 in outlet core 40. A lip 41 prevents outlet core 40 from traveling out the top of opening 14. Tabs 13 of module housing lock around lip 41 at tab reception areas 43. This keeps outlet core 40 securely in base module housing 10.

Figure 9:
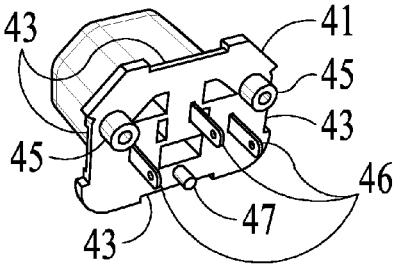

FIG. 9 shows leads 46 of outlet core 40 ready to establish electrical connection with a printed circuit board or other mounting destination of the module outlet. Support guides 45 and support guide 47 are used to support the assembled module outlet when the module outlet is mounted on a printed circuit board or other mounting destination of the module outlet.

Figure 10:
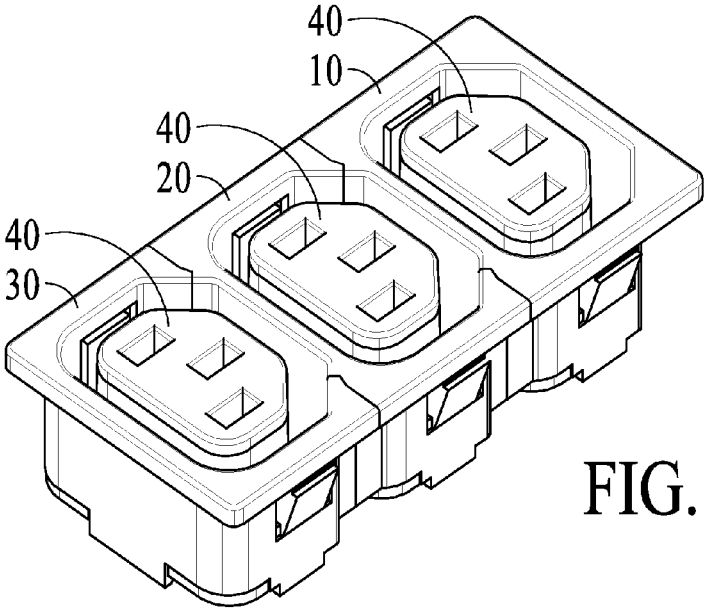
FIG. 10 and FIG. 11 how various views of a module outlet after assembly in accordance with an embodiment.
Figure 11:
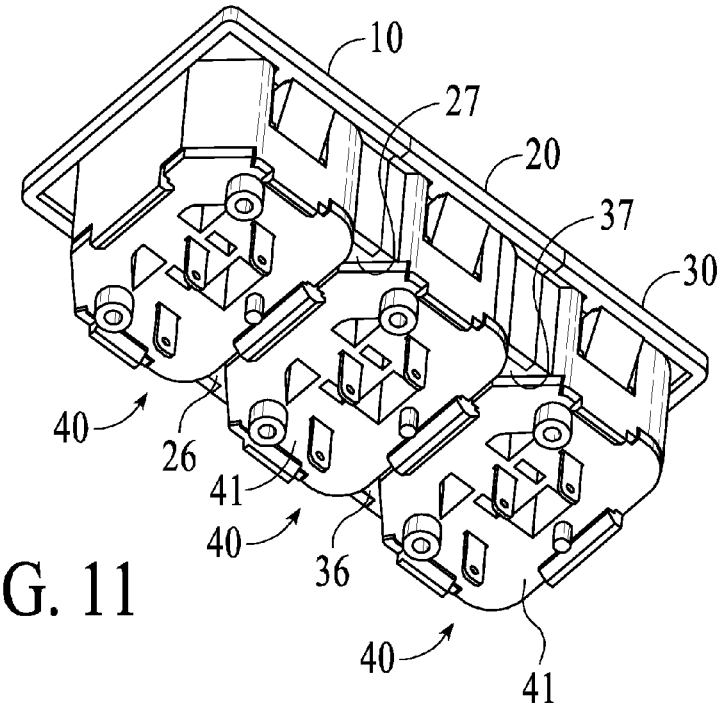

FIG. 10 and FIG. 11 show end module housing 30 assembled with middle module housing 20 and base module housing 10. For the outlet core 40 within opening 24 of middle module housing 20, lip 41 prevents outlet core 40 from traveling out the top of opening 24. Tabs 23 of middle module housing 20 and tab 15 of base module housing 10 lock around lip 41 at tab reception areas 43. This keeps outlet core 40 securely in middle module housing 20. Also, lip 41 partially covers dovetail tongue 26 of middle module housing 20 and dovetail groove 11 of base module housing 10, as well as dovetail tongue 27 of middle module housing 20 and dovetail groove 12 of base module housing 10. This locks dovetail tongue 26 within dovetail groove 11 and dovetail tongue 27 within dovetail groove 12, thus locking middle module housing 20 to base module housing 10. This assures stability of the housing of the module outlet when it is fully assembled.

Likewise, for the outlet core 40 within opening 35 of end module housing 30, lip 41 prevents outlet core 40 from traveling out the top of opening 35. Tabs 33 of end module housing 30 and tab 25 of middle module housing 20 lock around lip 41 at tab reception areas 43. This keeps outlet core 40 securely in end module housing 30. Also, lip 41 partially covers dovetail tongue 36 of end module housing 30 and dovetail groove 21 of middle module housing 20, as well as dovetail tongue 37 of end module housing 30 and dovetail groove 22 of middle module housing 20. This locks dovetail tongue 36 within dovetail groove 21 and dovetail tongue 37 within dovetail groove 22, thus locking middle module housing 20 to base module housing 10. This assures stability of the housing of the module outlet when it is fully assembled.

Figure 12:
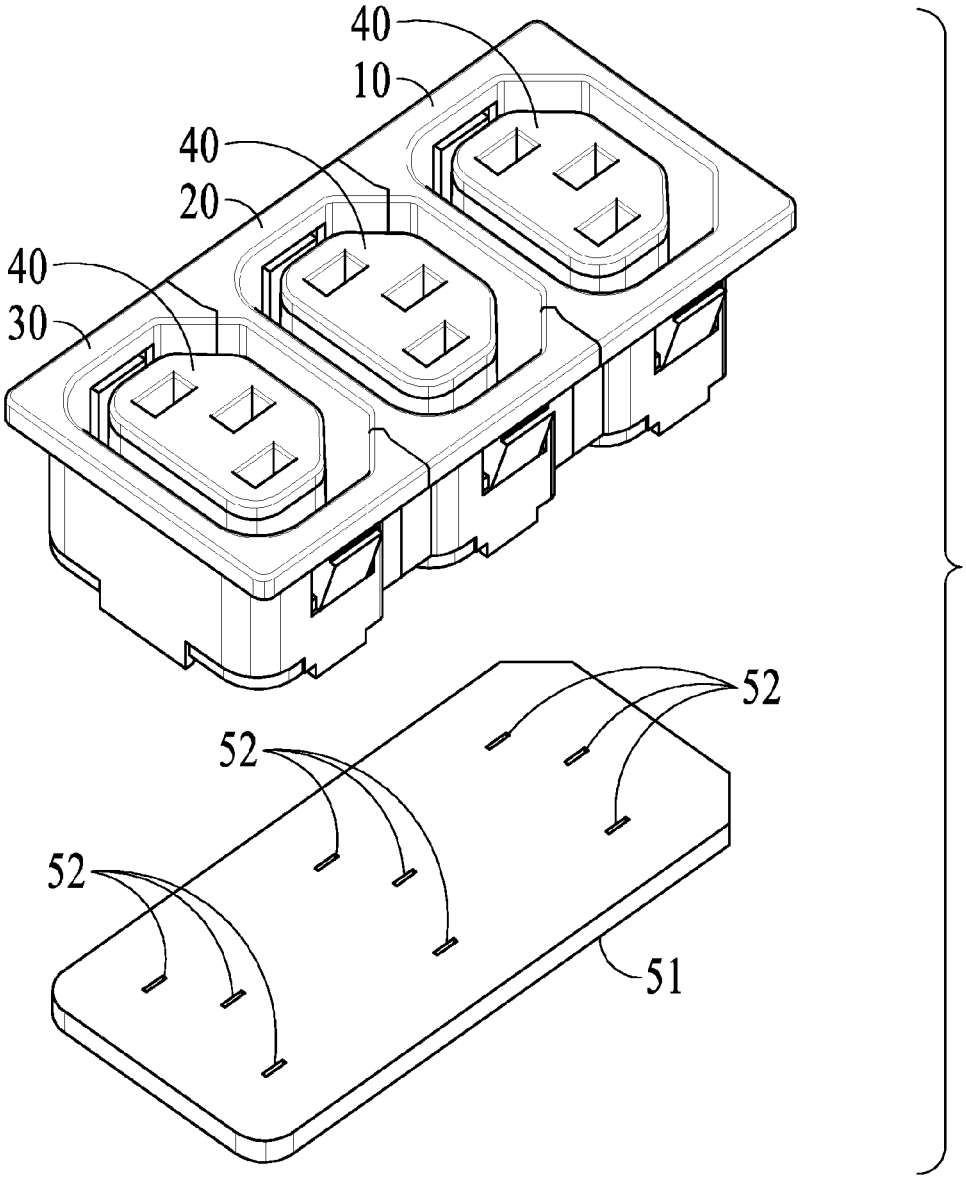
FIG. 12 and FIG. 13 show various views of a module outlet before placement on a printed circuit board in accordance with an embodiment.
Figure 13:
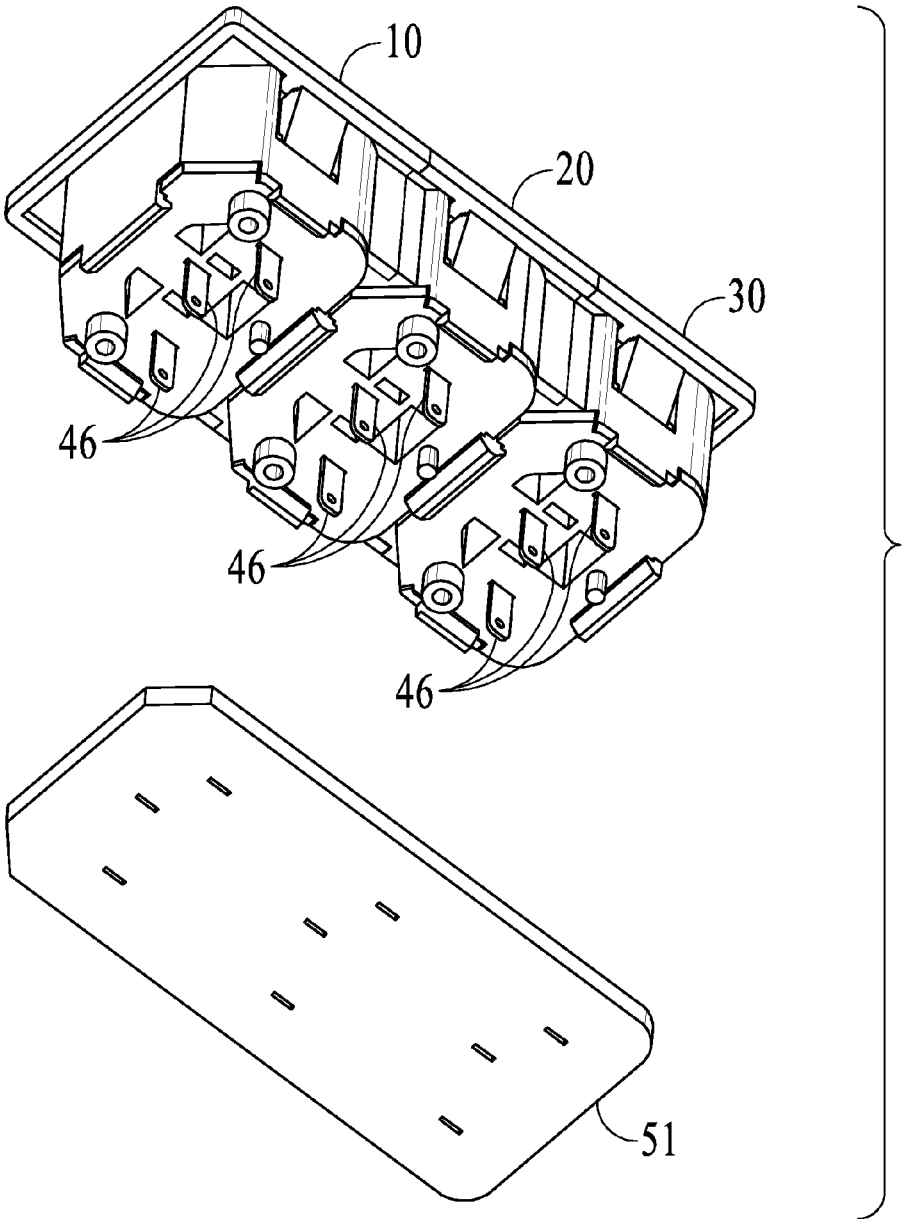

FIG. 12 and FIG. 13 show the assembled module outlet ready to be assembled onto a printed circuit board 51. Leads 46 of outlet cores 40 are placed in lead receptacles 52 on printed circuit board 51. Printed circuit board 51 can be sized to be assembled just with a module outlet, or printed circuit board 51 can be designed to be of sufficient size to receive other circuitry in addition to a module outlet.

Figure 14:
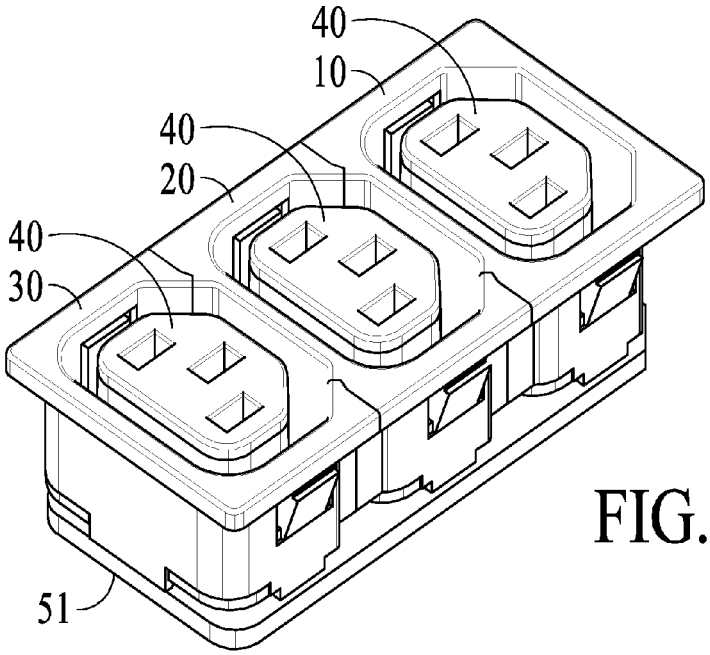
FIG. 14 shows a module outlet after placement on a printed circuit board in accordance with an embodiment.

FIG. 14 shows the assembled module outlet mounted onto printed circuit board 51.

Figure 15:
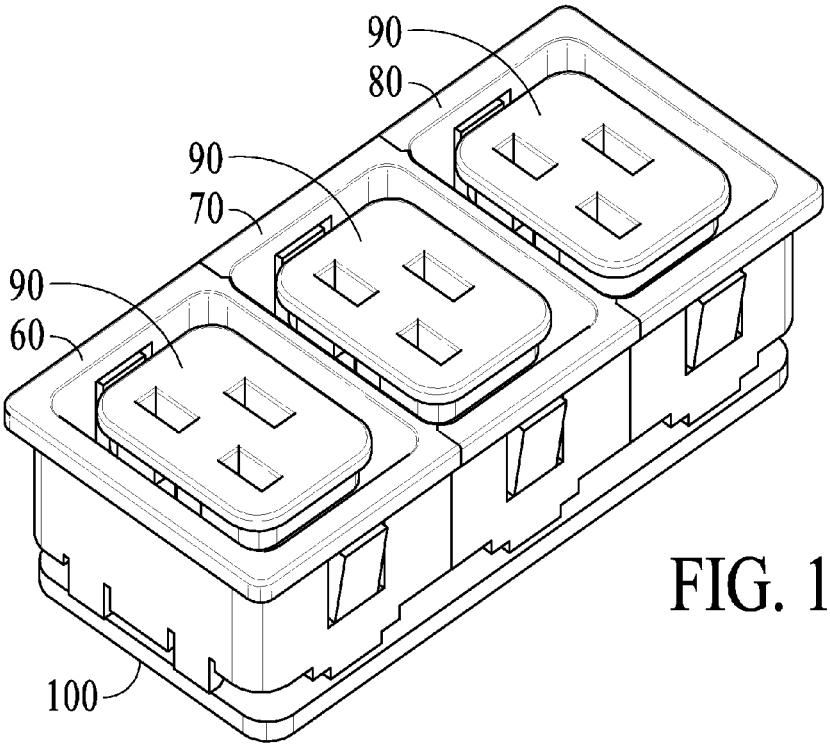
FIG. 15 shows a module outlet after placement on a printed circuit board in accordance with another embodiment.

Connectors other than C13 connector can serve as the basis of a module outlet. For example, FIG. 15 shows base module housing 60, middle module housing 70, end module housing 80 and outlet cores 90 assembled into a module outlet mounted on a printed circuit board 100. For example, each of outlet cores 90 is a C19 connector as specified by standards of International Electrotechnical Commission (IEC) 60320. Alternatively, each outlet core is another type of outlet compatible with another IEC standard or compatible with a standard from another standards organization or a special custom configuration.

Figure 16:
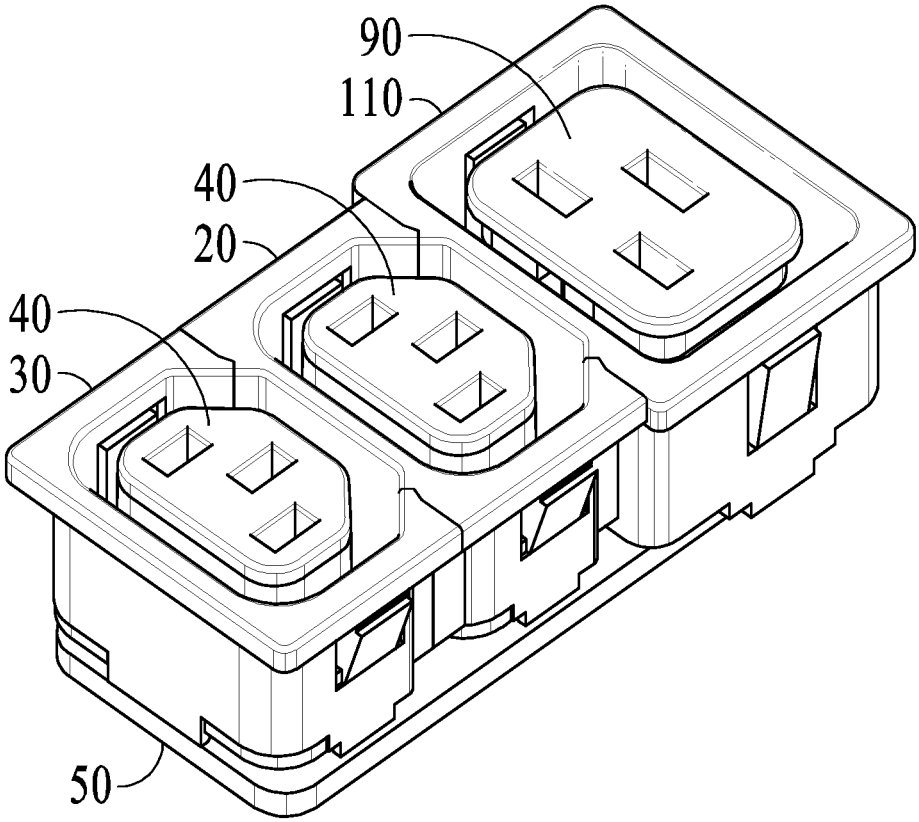
FIG. 16 shows a module outlet after placement on a printed circuit board in accordance with another embodiment.

Different types of connectors also can be assembled into a module outlet. For example, FIG. 16 shows base module housing 110, middle module housing 20, end module housing 30, outlet cores 40 and an outlet core 90 assembled into a module outlet mounted on printed circuit board 50. For example, each of outlet cores 40 is a C13 connector and outlet core 90 is a C19 connector as specified by standards of International Electrotechnical Commission (IEC) 60320. Alternatively, one or more of the outlet cores is another type of outlet compatible with another IEC standard or compatible with a standard from another standards organization.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A module outlet comprising:

a first outlet core, including:

a body having plug receptacles, and a lip area;

a second outlet core, including:

a body having plug receptacles, and a lip area;

first module housing, the first module housing including:

a first opening in which the body of the first outlet core is placed, the lip area of the first outlet core preventing the first outlet core from travelling through the first opening, a tab configured to hold the body of the first outlet core secure within the first opening, and a dovetail groove; and second module housing, the second module housing including:

a second opening in which the body of the second outlet core is placed, the lip area of the second outlet core preventing the second outlet core from travelling through the second opening, a tab configured to hold the body of the second outlet core secure within the second opening, and a dovetail tongue that has been slid into the dovetail groove, wherein the lip of the first outlet core or the lip of the second outlet core overlaps at least part of the dovetail groove of the first outlet body securing the dovetail tongue within the dovetail groove.

2. A module outlet as in claim 1, wherein the second module housing additionally includes:

a dovetail groove.

3. A module outlet as in claim 2, additionally comprising:

a third outlet core, including:

a body having plug receptacles, and a lip area; and third module housing, the third module housing including:

a third opening in which the body of the third outlet core is placed, the lip area of the third outlet core preventing the third outlet core from travelling through the third opening, a tab configured to hold the body of the third outlet core secure within the third opening, and a dovetail tongue that has been slid into the dovetail groove of the second module housing, wherein the lip of the second outlet core or the lip of the third outlet core overlaps at least part of the dovetail groove of the second outlet body securing the dovetail tongue of the third module housing within the dovetail groove.

4. A module outlet as in claim 1 wherein the tab configured to hold the body of the first outlet core secure within the first opening is one of four tabs configured to hold the body of the first outlet core secure within the first opening.

5. A module outlet as in claim 1:

wherein the dovetail groove is one of two dovetail grooves included in the first module housing; and wherein the dovetail tongue is one of two dovetail tongues included in the second module housing.

6. A module outlet as in claim 1 wherein the tab configured to hold the body of the second outlet core secure within the second opening is one of four tabs configured to hold the body of the second outlet core secure within the second opening, wherein three of the four tabs are included in the second module housing and one of the four tables is included in the first module housing.

7. A module outlet as in claim 1 wherein the first module additionally includes a tab configured to hold the body of the second outlet core secure within the second opening.

8. A module outlet as in claim 1 wherein the first outlet core is a C13 connector or a C19 connector as specified by standards of International Electrotechnical Commission (IEC) 60320.

9. A module outlet as in claim 1 wherein the first outlet core is a C13 connector the second outlet core is a C19 connector as specified by standards of International Electrotechnical Commission (IEC) 60320.

10. Housing for a module outlet, the housing comprising:

first module housing, the first module housing including:

a first opening configured to receive a body of a first outlet core so that a lip area of the first outlet core prevents the first outlet core from travelling through the first opening, a tab configured to hold the body of the first outlet core secure within the first opening, and a dovetail groove; and second module housing, the second module housing including:

a second opening configured to receive a body of a second outlet core so that a lip area of the second outlet core prevents the second outlet core from travelling through the second opening, wherein when the first module housing is attached to the second module housing, a first side of the second opening is formed by a side of the first module and wherein the first side is open-ended when the first module housing is not attached to the second module housing, a tab configured to hold the body of the second outlet core secure within the second opening, and a dovetail tongue configured for sliding into the dovetail groove.

11. Housing as in claim 10, additionally comprising:

third module housing, the third module housing including:

a third opening configured to receive a body of a third outlet core so that a lip area of the third outlet core prevents the third outlet core from travelling through the third opening, a tab configured to hold the body of the third outlet core secure within the third opening, and a dovetail tongue configured for sliding into a dovetail groove included in the second module housing.

12. Housing as in claim 11, additionally comprising:

fourth module housing, the fourth module housing including:

a fourth opening configured to receive a body of a fourth outlet core so that a lip area of the fourth outlet core prevents the fourth outlet core from travelling through the fourth opening, a tab configured to hold the body of the fourth outlet core secure within the fourth opening, and a dovetail tongue configured for sliding into a dovetail groove included in the third module housing.

13. Housing as in claim 10:

wherein the dovetail groove is one of two dovetail grooves included in the first module housing; and wherein the dovetail tongue is one of two dovetail tongues included in the second module housing.

14. Housing as in claim 10 wherein the first module additionally includes a tab configured to hold the body of the second outlet core secure within the second opening.

15. Housing for a module outlet, the housing comprising:

first module housing, the first module housing including:

a first opening configured to receive a body of a first outlet core so that a lip area of the first outlet core prevents the first outlet core from travelling through the first opening, a tab configured to hold the body of the first outlet core secure within the first opening, and a dovetail tongue configured for sliding into a dovetail groove of a second module housing so as to secure the first module housing to a second module housing, wherein when the first module housing is secured to the second module housing, a first side of the first opening is formed by the second module and wherein the first side is open-ended when the first module housing is not secured to the second module housing.

16. Housing as in claim 15:

wherein the dovetail tongue is one of two dovetail tongues configured for sliding into dovetail grooves of the second module housing so as to secure the first module housing to the second module housing.

17. Housing as in claim 15 wherein the tab configured to hold the body of the first outlet core secure within the first opening is one of four tabs configured to hold the body of the first outlet core secure within the first opening, wherein three of the four tabs are included in the first module housing and one of the four tabs is included in the second module housing.

18. Housing as in claim 15 wherein the first outlet core is a C13 connector or a C19 connector as specified by standards of International Electrotechnical Commission (IEC) 60320.

19. Housing as in claim 15 wherein the first outlet core is a custom configuration not specified by standards of International Electrotechnical Commission (IEC) 60320.

20. Housing for a module outlet, the housing comprising:

first module housing, the first module housing including:

a first opening configured to receive a body of a first outlet core so that a lip area of the first outlet core prevents the first outlet core from travelling through the first opening, a tab configured to hold the body of the first outlet core secure within the first opening, and a dovetail tongue configured for sliding into a dovetail groove of a second module housing so as to secure the first module housing to a second module housing, wherein when the first module housing is secured to the second module housing, a first side of the second opening is formed by the first module and wherein the first side is open-ended when the first module housing is not secured to the second module housing;

wherein the dovetail tongue is one of two dovetail tongues configured for sliding into dovetail grooves of the second module housing so as to secure the first module housing to the second module housing; and, wherein the tab configured to hold the body of the first outlet core secure within the first opening is one of four tabs configured to hold the body of the first outlet core secure within the first opening, wherein three of the four tabs are included in the first module housing and one of the four tabs is included in the second module housing.

* * * * *